US006415492B1

(12) United States Patent
Jamison

(10) Patent No.: US 6,415,492 B1
(45) Date of Patent: Jul. 9, 2002

(54) TRUCK BUSHING TOOL

(76) Inventor: Robert W. Jamison, 7995 High Bank Rd., Central Point, OR (US) 97502

( * ) Notice: Subject to any disclaimer, the term of this patent is extended or adjusted under 35 U.S.C. 154(b) by 0 days.

(21) Appl. No.: 09/609,545

(22) Filed: Jul. 3, 2000

Related U.S. Application Data

(60) Provisional application No. 60/171,304, filed on Dec. 21, 1999.

(51) Int. Cl.[7] ..... B25B 27/14
(52) U.S. Cl. ..... 29/275; 29/254; 29/255
(58) Field of Search ..... 29/275, 254, 255; 83/686, 684–691

(56) References Cited

U.S. PATENT DOCUMENTS

| | | | | | |
|---|---|---|---|---|---|
| 199,715 | A | * | 1/1878 | Jenkins | 29/275 |
| 1,587,916 | A | * | 6/1926 | Malone | 29/275 |
| 2,214,701 | A | * | 9/1940 | Scull | 83/686 |
| 2,522,440 | A | * | 9/1950 | Freter | 29/275 |
| 2,736,955 | A | | 3/1956 | Fuglie | |
| 3,208,134 | A | | 9/1965 | Krewson, Jr. | |
| 3,209,445 | A | | 10/1965 | Moskovitz | |
| 4,339,865 | A | | 7/1982 | Shultz | |
| 4,494,290 | A | | 1/1985 | Rutledge | |
| 4,724,608 | A | | 2/1988 | Parrott | |
| 5,001,822 | A | * | 3/1991 | Upthegrove | 29/275 |
| 5,218,749 | A | * | 6/1993 | Upthegrove | 29/275 |
| 5,355,572 | A | | 10/1994 | Kammeraad et al. | |
| 5,400,499 | A | | 3/1995 | Tsukida et al. | |

FOREIGN PATENT DOCUMENTS

| | | |
|---|---|---|
| RU | 878-570 | 11/1981 |

* cited by examiner

*Primary Examiner*—Joseph J. Hail, III
*Assistant Examiner*—Lee Wilson
(74) *Attorney, Agent, or Firm*—Richard C. Litman

(57) ABSTRACT

A tool for use in combination with an air pressure hammer for removal and installation of truck brake's anchor pin bushings, and made up of a solid cylindrical metal body having six contiguous regions with different diameters.

4 Claims, 1 Drawing Sheet

TRUCK BUSHING TOOL

CROSS-REFERENCE TO RELATED APPLICATION

This application claims the benefit of U.S. Provisional Patent Application Ser. No. 60/171,304, filed Dec. 21, 1999.

BACKGROUND OF THE INVENTION

1. Field of the Invention

The present invention relates generally to tools. More specifically, the invention is a truck brake's anchor pin bushing removal and installing tool designed to work with an air pressure hammer.

2. Description of Related Art

The relevant art of interest describes various bushing tools with and without the use of air pressure, but none discloses the tool configuration of the present invention. There is a need for removing the brake anchor pin bushings from a truck's brake system by applying available air pressure from an air hammer for quickly and efficiently removing the bushing. The relevant art will be discussed in the order of perceived relevance to the present invention.

U.S. Pat. No. 3,209,445 issued on Oct. 5, 1965, to Milton A. Moskovitz describes a combination tool for removing from and installing bushings by press-fitting into a linkage member of an automobile with the aid of an air hammer. The tool is cylindrical and has six discrete regions differing in diameter. The bushing is a hollow cylindrical metal shell with a rubber lining encased within an inner metal shell. The first pilot portion has a beveled face and adjoins a second pilot portion having a larger diameter. The third portion is a first shoulder or peripheral flange portion which supports a metal ring which abuts the bushing. The fourth portion is described as a main element which is narrowed and extended. The fifth portion is a second shoulder or peripheral flange having a smaller diameter than the first shoulder. The last sixth portion is a grip portion for a pneumatic hammer and has a smaller diameter than the main element. However, a critical required element is a ring collar or annulus of the combination tool which fits the second pilot portion and abuts the bottom of the bushing member with an external rim portion. A modification of the ring collar has its length increased in FIG. 2. Therefore, the combination tool is distinguishable for its required ring collar and the numerous flanges and pilot portions.

U.S. Pat. No. 5,355,572 issued on Oct. 18, 1994, to James A. kammeraad et al. describes a valve guide insert insertion tool for lining a valve guide of an internal combustion engine, which tool being formed from a metal tube with opposing ends having a tapered insertion section. The driver tool has three basic parts starting with the cylindrical shank section having six regions, a cylindrical driver section with a reduced diameter, and a cylindrical mandrel or pilot section having a further reduced diameter. Beginning from the beveled driver end in the cylindrical shank section, (1) a protrusion portion 90 (FIG. 8), (2) a rear enlargement portion 88, (3) a second cylindrical shank portion (no reference character) with a larger diameter, (4) a front enlargement portion 86 with a second depression and a front ridge to anchor the spring 96, (5) a cylindrical driver section 76, and (6) a cylindrical mandrel or pilot section having the smallest diameter and joined to the driver section 76 by a driving shoulder 84. The driver tool is distinguishable for its six-region structure with three shoulders.

U.S. Pat. No. 4,494,290 issued on Jan. 22, 1985, to Seth E. Rutledge describes a split bushing and tool kit for grasping the bushing at its apertures for axial insertion or removal from a bushing sleeve or boss formed in a support housing for a camshaft of a truck brake system. The special bushings have skewed split cuts with end cuts and apertures for receiving a special tool comprising a U-shaped flexible rod having a bight portion at one end and fingers at the opposite end with a sliding band or collar for holding the fingers in the apertures of the special bushings. The split bushing and tool kit combination is distinguishable for their special adaptation.

U.S. Pat. No. 3,208,134 issued on Sep. 28, 1965, to Walter I. Krewson, Jr. describes an automobile bushing removal tool used with a spring element for holding various shanked tools having beveled ends or forked ends onto an air hammer device. The tools are distinguishable for their uniquely configured ends.

U.S. Pat. No. 4,339,865 issued on Jul. 20, 1982, to William E. Shultz describes a tool for removing and installing bushings and bearings in a vehicle's transmission pump. The tool consists of a knurled driving end of a cylindrical driving shaft, connected to a separate driving shaft portion with depth stop sleeve alignment slots which is connected to a bushing or bearing contacting end having O-rings. The contacting end is connected to a bushing or bearing driving mandrel having annular segments held by O-rings. A depth stop sleeve fits over the connection of the driving shafts for use in insertion only. Finally, a knurled mandrel spreader is attached to the drive shaft through the contacting end. The tool is distinguishable for its extensive required separate parts comprising two drive shafts, a depth stop sleeve, a contacting end, a driving mandrel, and a mandrel spreader.

U.S. Pat. No. 2,736,955 issued on Mar. 6, 1956, to Elmer A. Fuglie describes a tool for removing and installing press-fit bushings by using a vertical drill press. The two-piece tool consists of a tubular portion having a tubular head abutting a heavy shoulder of the banded body which has six spaced longitudinally arranged kerfs forming expandable spring fingers. A solid inserting member is inserted in the bushing engaging member. The tool is distinguishable for its two-piece tool with expandable fingers.

U.S. Pat. No. 4,724,608 issued on Feb. 16, 1988, to Ronald J. W. Parrott describes an extractor tool for bearings and bushings and an installer body for hammering in a new bearing or bushing. The puller has a cup-shaped outer puller body and a hexagonal nut holding a bolt with a threaded inner puller body having six flexible fingers, and an abutting lip and wedge member at an opposite end which is inserted into the bearing or bushing. The extractor tool is distinguishable for its bolt action feature.

U.S. Pat. No. 5,218,749 issued on Jun. 15, 1993, to Robert Upthegrove describes a handheld punch tool assembly with removable punch segments with threaded shafts. The solid cylindrical punch segments decrease in diameter. The punch tool is distinguishable for its pyramidal structure in detachable cylindrical punch parts.

U.S. Pat. No. 5,400,499 issued on Mar. 28, 1995, to Robert S. Tsukida et al. describes an internal bushing removal tool for extracting bushings from a piston coupling of a control rod drive (CRD) of a boiling water reactor. The tool incorporates a spring-loaded collet supported on one end by a ram and a pair of arms with shoulders which latch inside the internal bushing ring to be removed. The tool is distinguishable for its spring-loaded collet structure.

Soviet Union Pat. No. 878-570 issued on Nov. 7, 1981, to Mach Tractor Park describes a hollow bushing extractor having a bar with an axial channel and slot for accommodating a plunger and a thrust plate pin. The tool is distinguishable for its required internal spring action.

None of the above inventions and patents, taken either singly or in combination, is seen to describe the instant invention as claimed.

SUMMARY OF THE INVENTION

The invention is, essentially, a tool to be used in combination with an air pressure hammer for the quick and efficient removal and installation of a truck brake's anchor pin bushings.

Accordingly, it is a principal object of the invention to provide a unique truck brake's anchor pin bushing removal and installation tool.

It is another object of the invention to provide a unique truck brake's anchor pin bushing removal and installing tool utilizing an air hammer.

It is a further object of the invention to provide a unique truck brake's anchor pin bushing removal and installing tool utilizing an air hammer for work on the brakes of trucks and trailers.

Still another object of the invention is to provide a unique truck brake's anchor pin bushing removal and installing tool having a shank configuration which gradually increases in diameter towards the bushing-engaging end to assist in forcing the brake's anchor pin bushing in or out of the anchor pin aperture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
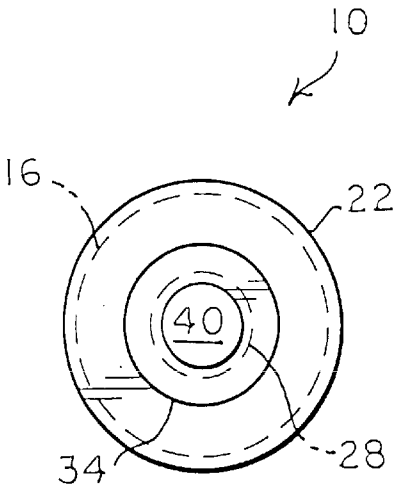
FIG. 2 is a rear end view of the truck bushing tool.
Figure 1:
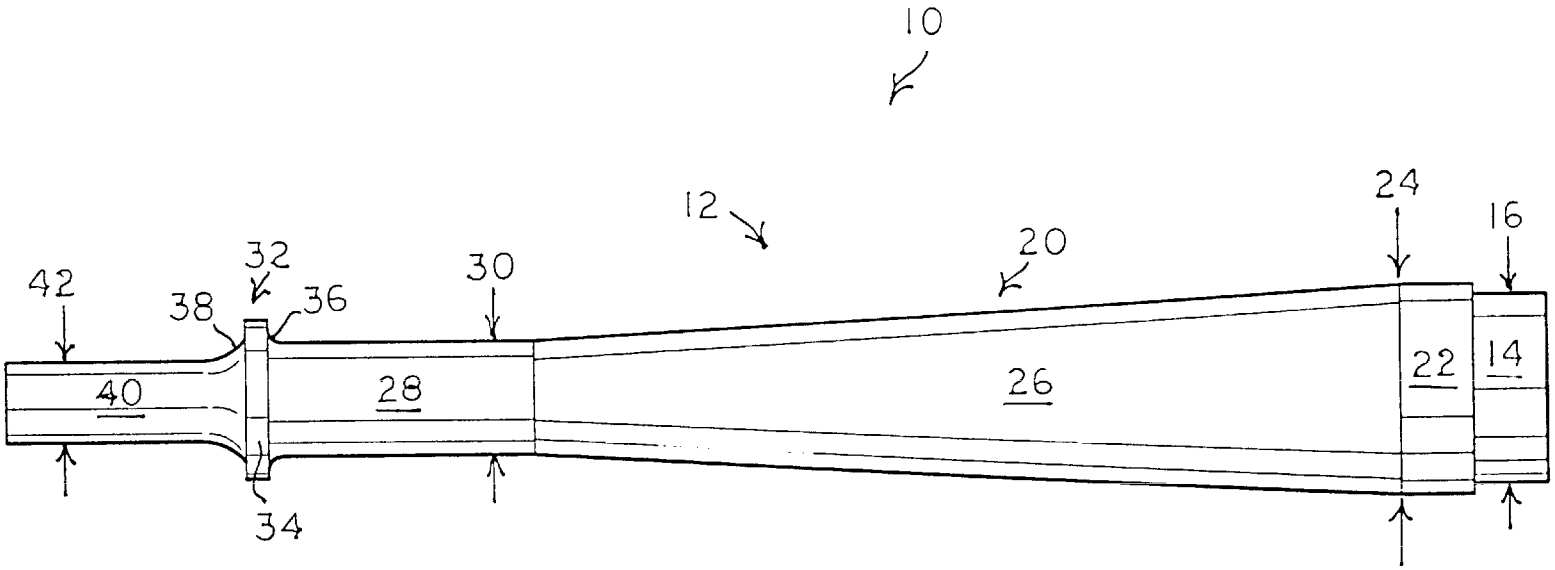
FIG. 1 is an elevational side view of a truck bushing tool according to the present invention.

The present invention is illustrated in FIGS. 1 and 2 to show the tool 10, affectionately called a "bush whacker" because it effectively removes and replaces the anchor pin bushings in the brake spiders on the brake assemblies of diesel tractor and trailers. Previously, a hand held bushing driver and hammer would be a tedious, dangerous and time consuming job for a mechanic. It has been found that time required for the removal and replacement procedure has been cut in half and made safer for the mechanic.

The tool 10 in combination with an air pressure hammer (not shown) for removal and installation of a truck brake's anchor pin bushings comprises a solid cylindrical metal body 12 having six contiguous cylindrical regions with different diameters. A first pilot region 14 has a first diameter 16 and a flat end surface 18 for abutting a truck brake's anchor pin bushing.

A shank section 20 has a second region 22 with the largest second diameter 24, a third extended region 26 decreasing in diameter, and a fourth region 28 with a reduced constant diameter 30. A fifth region 32 has a shoulder 34 with a larger diameter than the fourth region. For structural reasons, gradually decreasing regions 36 (right) and 38 (left) are formed on either side of the shoulder region 34. A sixth region 40 is a driver region with a reduced diameter 42 for insertion in an air pressure hammer.

Exemplary dimensions for a tool 10 which is $10\frac{15}{16}$ in. long are as follows:

Pilot region 16: 0.5 in. length; 1.240 in. diameter.

Shank 20: total length, 8.06 in.; region 22, 0.5 in. length, 1.365 in. diameter; region 26, 5.81 in. length, diameter ranging from 0.5 in. to 1.365 in.; region 28, 1.75 in. length, 0.5 in. diameter; right region 36, $\frac{3}{32}$ in. radius.

Shoulder region 32: $\frac{5}{32}$ in. length, 0.758 in. diameter, left region 38, $\frac{3}{8}$ in. radius.

Driver region 40: $1\frac{19}{32}$ in. length, 0.393 in. diameter.

Thus, a dependable, time-saving and safe bushing tool has been shown. It should be noted that this tool can be made in an assortment of sizes depending on the make of the truck.

It is to be understood that the present invention is not limited to the sole embodiment described above, but encompasses any and all embodiments within the scope of the following claims.

I claim:

1. A tool for use in combination with an air pressure hammer for removal and installation of a truck brake's anchor pin brushings, said tool comprising:

a solid cylindrical metal body having a length and six contiguous regions with different diameters, said regions including:

a first pilot region having a first constant diameter and a flat end surface for abutting a truck brake's anchor pin bushing;

a shank section having a second region with a second largest diameter, a third extended region decreasing in diameter and having a length greater than one-half the length of said body, and a fourth region with a reduced constant diameter;

a fifth region constituting a shoulder region with a larger diameter than the fourth region; and a sixth region constituting a driver region with a reduced diameter for insertion in an air pressure hammer;

whereby removal and installation of a truck brake's anchor pin bushings is accomplished by utilizing the tool.

2. The tool according to claim 1, wherein said body includes gradually decreasing regions on either side of the shoulder region for ensuring structural integrity of the shoulder region.

3. The tool according to claim 1, wherein said tool is of monolithic, one-piece construction.

4. The tool according to claim 3, wherein said tool is made of steel.

* * * * *